US007527774B2

(12) United States Patent
Galligan

(10) Patent No.: US 7,527,774 B2
(45) Date of Patent: May 5, 2009

(54) INLET METALLIC FOAM SUPPORT COUPLED TO PRECIOUS METAL CATALYST FOR APPLICATION ON 4 STROKE PLATFORMS

(75) Inventor: Michael Patrick Galligan, Cranford, NJ (US)

(73) Assignee: BASF Catalysts LLC, Florham Park, NJ (US)

( * ) Notice: Subject to any disclaimer, the term of this patent is extended or adjusted under 35 U.S.C. 154(b) by 550 days.

(21) Appl. No.: 11/316,094

(22) Filed: Dec. 22, 2005

(65) Prior Publication Data

US 2007/0144828 A1 Jun. 28, 2007

(51) Int. Cl.

| | |
|---|---|
| ***B01D 53/94*** | (2006.01) |
| ***F01N 1/00*** | (2006.01) |
| ***F01N 3/10*** | (2006.01) |
| ***F01N 5/00*** | (2006.01) |

(52) U.S. Cl. ..... 423/213.2; 423/213.5; 181/212; 181/228; 181/258; 181/272; 60/273; 60/274; 60/282; 60/299

(58) Field of Classification Search ..... 423/213.2, 423/213.5; 181/212, 228, 258, 272; 60/273, 60/274, 282, 299

See application file for complete search history.

(56) References Cited

U.S. PATENT DOCUMENTS

| | | | |
|---|---|---|---|
| 3,111,396 | A | 11/1963 | Ball |
| 3,968,854 | A | 7/1976 | Gordon et al. |
| 4,027,367 | A | 6/1977 | Rondeau |
| 4,335,023 | A | 6/1982 | Dettling et al. |
| 4,414,023 | A | 11/1983 | Aggen et al. |
| 4,418,790 | A | 12/1983 | Agnew |
| 4,420,316 | A | 12/1983 | Frost et al. |
| 4,671,931 | A | 6/1987 | Herchenroeder et al. |
| 4,674,447 | A | 6/1987 | Davis |
| 4,774,217 | A | 9/1988 | Takeuchi et al. |
| 4,813,231 | A | 3/1989 | Bykowski |
| 4,900,712 | A | 2/1990 | Bar-Ilan et al. |
| 4,985,210 | A | 1/1991 | Minami |
| 5,100,632 | A | 3/1992 | Detling et al. |
| 5,283,041 | A | 2/1994 | Nguyen et al. |
| 5,421,154 | A | 6/1995 | Pfefferle et al. |

(Continued)

FOREIGN PATENT DOCUMENTS

| | | |
|---|---|---|
| DE | 10212236 | 2/2003 |

OTHER PUBLICATIONS

PCT/US2006/047712 PCT Written Opinion of the International Searching Authority, (Apr. 24, 2007), 5 pgs.

(Continued)

*Primary Examiner*—Timothy C Vanoy
(74) *Attorney, Agent, or Firm*—Scott S. Servilla; Diehl Servilla LLC; Melanie L. Brown

(57) ABSTRACT

The present invention is directed to an improved dual phase muffler for the abatement of reduction of sound and emission pollutants such as hydrocarbons, carbon monoxide, and nitrogen oxides. More specifically, the muffler comprises a muffler casing, an inner chamber formed in the muffler, and a catalytically coated supported material contained within the inner chamber. The present invention is also directed to a catalytically coated metallic foam catalyst support, which optionally can be pre-coat with a metallic thermal arc sprayed layer.

19 Claims, 3 Drawing Sheets

U.S. PATENT DOCUMENTS

| | | | | |
|---|---|---|---|---|
| 5,422,331 | A | 6/1995 | Galligan et al. | |
| 5,437,152 | A | 8/1995 | Pfefferle et al. | |
| 5,448,831 | A | 9/1995 | Harwood | |
| 5,612,006 | A | 3/1997 | Fisk | |
| 5,620,672 | A | 4/1997 | Galligan et al. | |
| 5,696,065 | A | 12/1997 | Tanaka et al. | |
| 5,721,188 | A | 2/1998 | Sung et al. | |
| 5,736,690 | A * | 4/1998 | Karlsson | 181/230 |
| 5,763,352 | A | 6/1998 | Jung et al. | |
| 5,829,248 | A | 11/1998 | Clifton | |
| 5,916,128 | A | 6/1999 | Garr et al. | |
| 6,003,305 | A | 12/1999 | Martin et al. | |
| 6,040,266 | A | 3/2000 | Fay, III et al. | |
| 6,047,544 | A | 4/2000 | Yamamoto et al. | |
| 6,068,082 | A | 5/2000 | D'Amico, Jr. et al. | |
| 6,074,973 | A | 6/2000 | Lampert et al. | |
| 6,098,745 | A | 8/2000 | Zalben | |
| 6,109,026 | A | 8/2000 | Karlsson et al. | |
| 6,250,422 | B1 | 6/2001 | Goplen et al. | |
| 6,287,527 | B1 | 9/2001 | Kawanami et al. | |
| 6,319,484 | B1 | 11/2001 | Shore et al. | |
| 6,394,225 | B1 | 5/2002 | Yasuda | |
| 6,604,604 | B1 * | 8/2003 | Badeau et al. | 181/258 |
| 6,622,482 | B2 | 9/2003 | Knight et al. | |
| 6,770,252 | B2 | 8/2004 | Cheng | |
| 6,773,479 | B2 | 8/2004 | Debenedetti et al. | |
| 6,773,481 | B2 | 8/2004 | Noguchi et al. | |
| 6,810,660 | B2 | 11/2004 | Hepburn et al. | |
| 6,821,491 | B1 | 11/2004 | Bruck et al. | |
| 2001/0027165 | A1 | 10/2001 | Galligan et al. | |
| 2002/0128151 | A1 | 9/2002 | Galligan et al. | |
| 2003/0165414 | A1 | 9/2003 | Galligan et al. | |
| 2004/0009106 | A1 | 1/2004 | Galligan et al. | |
| 2004/0038819 | A1 | 2/2004 | Galligan et al. | |
| 2004/0050618 | A1 * | 3/2004 | Marocco | 181/248 |
| 2004/0087439 | A1 | 5/2004 | Hwang et al. | |
| 2005/0163677 | A1 | 7/2005 | Galligan et al. | |

OTHER PUBLICATIONS

PCT/US2006/047712 PCT International Search Report, (Apr. 24, 2007), 4 pgs.

U.S. Appl. No. 11,321,254, "Metallic Foam Trap for Poisons: Aircraft Ozone", Galligan et al., filed Dec. 29, 2005.

U.S. Appl. No. 11/316,594, "Exhaust Inlet Metallic Foam Trap Coupled to a Downstream Monolithic Precious Metal Catalyst", Galligan et al., filed Dec. 22, 2005.

U.S. Appl. No. 11/050,383, "Deflector Plate to Enhance Fluid Stream Contact with a Catalyst", Galligan, Michael, filed Feb. 3, 2005.

Arun D. Jatkar, "A New Catalyst Support Structure For Automotive Catalytic Converters", SAE Technical Paper 971032, Congress and Exposition, Detroit, Michigan, Feb. 24-27, 1997.

Pizzirusso, Joseph F., "The Unique Properties of Polyurethane Foam for Small Engine Filters", SAE 951811, Sep. 13-15, 1995.

Poon et al., "Fractional Efficiency and Particle Mass Loading Characteristics of Engine Air Filters", SAE 970673, Feb. 24-27, 1997.

Stankiewicz et al., Properties and Performance of UltraCat(TM) Open-Cell Silicon Carbide Foam Catalyst Substrates, SAE 980669, Feb. 23-26, 1998.

Storey et al., "Analysis of Semivolatile Organic Compounds in Diesel Exhaust Using A Novel Sorption and Extraction Method", SAE 1999-01-3534, Oct. 25-28, 1999.

Nelson et al., "Reduction in Emissions and Noise from a 500 cc Snowmobile", SAE 2000-01-2575, Sep. 11-13, 2000.

Zhi et al., "Development and Experimental Study of a New Diesel Exhaust Particulate Trap System", SAE 2000-01-2846, Oct. 16-19, 2000.

Van Setten et al., "Molten Salts Supported on Ceramic Foam in the Potential Application of Diesel Soot Abatement Technology", SAE 2001-01-0905, Mar. 5-8, 2001.

Boretto et al., "Diesel Particulate Filter Based on Ceramic Foams", CNR 1999-24-0052, 4th International Conference on Internal Combustion Engines: Experiments and Modeling, Capri, Naples, Italy, Sep. 12-16, 1999.

International Search Report for International No. PCT/US2006/047712, 2007.

* cited by examiner

INLET METALLIC FOAM SUPPORT COUPLED TO PRECIOUS METAL CATALYST FOR APPLICATION ON 4 STROKE PLATFORMS

FIELD OF THE INVENTION

The present invention relates to a muffler assembly and in particular to a muffler assembly of a type used to dampen exhaust noise produced by internal combustion engines having a catalytic converter therein.

BACKGROUND OF THE INVENTION

The present invention relates to low cost catalytic articles and methods for treating a fluid stream, e.g., a gaseous fluid stream. Among other things, the articles and methods disclosed herein are well suited for converting pollutant components in exhaust streams produced by small engines to innocuous components. The exhaust gases of internal combustion engines, including small engines, are known to contain pollutants such as hydrocarbons, carbon monoxide and nitrogen oxides (NOx) that foul the air.

More stringent emission regulations for devices powered by small internal combustion engines are increasingly being mandated by various regulatory agencies. By small engines, it is meant that the engines, usually two-stroke and four-stroke spark ignition engines, have a displacement of less than about 75 and preferably less than 35 cubic centimeters. Such engines ("utility engines") are found, in particular, in gasoline-engine powered lawn mowers, motorized chain saws, portable generator units, snow blowers, grass/leaf blowers, string mowers, lawn edgers, garden tractors, motor scooters, motorcycles, mopeds, and like devices. Such engines provide a severe environment for a catalytic exhaust treatment apparatus. This is because in small engines, the exhaust gas contains a high concentration of unburned fuel and unconsumed oxygen. Since the users of many of such devices (e.g., motorized saws, lawn mowers, string cutters) work in close proximity to the devices, the concern for reducing the emissions is heightened.

Exhaust treating catalyst articles offer one solution toward reducing emissions from devices powered by small engines. However, practical integration of catalytic articles into such devices can be difficult because the operating conditions for small engines pose difficult design challenges.

First, the catalyst article must be durable. In comparison to devices powered by larger engines (e.g., an automobile), devices powered by smaller engines are less able to absorb and diffuse the vibrations caused by the engine. The vibrational force in a two-stroke engine can be three or four times that of a four-stroke engine. For example, vibrational accelerations of 70 G to 90 G (G=gravitational acceleration) at 150 hertz (Hz) have been reported for small engines. The harsh vibration and exhaust gas temperature conditions associated with small engines lead to several modes of failure in the exhaust gas catalytic treatment apparatus, including failure of the mounting structure by which a catalyst member is secured in the apparatus and consequential damage or destruction of the catalyst member due to the mechanical vibration and to flow fluctuation of the exhaust gas under high temperature conditions. In addition, small engines provide less design flexibility with regard to the placement of the catalytic article. In devices powered by small engines, the close proximity of the catalytic article to the engine exposes the article to intense vibrations. Furthermore, small engines are characterized by high temperature variations as the load on the engine increases and decreases. Accordingly, a catalyst member used to treat the exhaust of a small engine is typically subjected to greater thermal variation and more vibration than the catalytic converter on an automobile, and these conditions have lead to spalling of catalytic material.

Second, the catalytic articles preferably accommodate high flow rates since the majority of small engine platforms exhibit high space velocities due to the limited size of the mufflers employed on these engines. For instance, a small engine having a displacement of 50 cubic centimeters operating with a maximum of 8,000 rpm typically has an exhaust output of 12,000-15,000 L/h. Catalyst articles that significantly restrict the flow rate of the exhaust stream are less desirable since higher backpressures within the exhaust system reduce the engine's operating efficiency. Moreover, as a result of the high flow rate of exhaust stream through the catalyst article, the catalyst composition employed must be highly active and optimally disposed within the article to ensure adequate pollutant conversions.

Third, the catalyst articles are preferably lightweight and occupy small volumes since many of the devices powered by small engines are handheld tools, e.g., weed trimmers, chainsaws. Excessive weight or unwieldy protrusions from such devices negatively restrict the applications that the devices were designed for.

Fourth, the cost of the emissions treatment system cannot significantly increase the overall cost of the device to ensure that the device remains competitive on the marketplace. Small engines typically power moderately priced devices. Accordingly, a need has arisen to design a catalytic article for treating the emissions of devices powered by small engines which meets expected standards, yet minimizes the added cost to the device.

Catalysts useful in small engine applications are described in U.S. Ser. No. 08/682,247, hereby incorporated by reference. Briefly such catalysts comprise one or more platinum group metal compounds or complexes, which can be on a suitable support material. Suitable support materials include refractory oxides such as alumina, silica, titania, silica-alumina, aluminosilicates, aluminum-zirconium oxide, aluminum-chromium oxide, etc. The catalytic materials are typically used in particulate form with particles in the micron-sized range, e.g., 10 to 20 microns in diameter, so that they can be formed into a slurry and applied as a washcoat on a carrier member. Suitable carrier members may be employed, such as a honeycomb-type carrier of the type having a plurality of fine, parallel gas-flow passages extending therethrough from an inlet or an outlet face of the carrier so that the passages are open to fluid-flow therethrough. The coater carrier is disposed in a canister suited to protect the catalyst member and to facilitate establishment of a gas flow path through the catalyst member, as is known in the art.

Commonly assigned U.S. Publication No. 2004/0087439, published May 6, 2004, discloses a catalyzed metallic substrate useful as part of exhaust systems which can be used with small engines for applications such as motorcycles, lawn mowers, chain saws, weed trimmers, and the like.

Commonly assigned U.S. Publication No. 2004/0038819, published Feb. 26, 2004, discloses a pliable refractory metal carrier may have coated thereon an anchor layer to improve adherence to the carrier of a catalytic coating. The conformable catalyst member may be bent to conform to a curved or bent exhaust pipe within which it is mounted.

Commonly assigned U.S. Publication No. 2002/0128151, published Sep. 12, 2002, discloses electric arc spraying a metal onto a foam substrate to produce an anchor layer on the substrate that serves as a surprisingly superior intermediate layer for a catalytic material deposited thereon. Spalling of catalytic material is resisted even when subjected to the harsh conditions imposed by small engines or in a close-coupled position for a larger engine. It is further disclosed that the catalytic coating can be applied to substrates such as foam, corrugated foils, or screens.

Typically, two separate units, a muffler and a catalytic converter, are employed in engines to minimize emission noise and air pollution, respectively, at two separate stages of the exhaust system. Mufflers typically are designed in one of three ways: (a) with staggered baffles; (b) with sound defeating angling; or (c) with fiberglass packing. Staggered baffled mufflers are the most commonly used in the industry because they are efficient, inexpensive and easy to manufacture.

Catalytic converters, on the other hand, are typically designed in two ways: (a) with a honeycomb material; or (b) with beads. Both the honeycomb material and the beads are used as supports which are coated with a catalytic substance which causes the undesirable and harmful compounds in the exhaust gas emission stream to be converted in a predetermined catalytic reaction into harmless components.

Hence, treatment of noise and air pollution within an exhaust gas emissions stream is accomplished conventionally by these two separate devices, each acting independently of one another. Accordingly, the conventional catalytic converter does not substantially silence exhausting emissions and the conventional muffler does not catalytically treat exhausting emissions.

The need to simultaneously reduce both noise and polluting emissions is of particular importance to manufactures of small internal combustion engines, such as those for tractors, lawn and yard maintenance equipment, motor bikes, scooters, snow and leaf blowers and other power equipment where there is an increasing demand for reducing emissions and noise levels. Most of such small engines are equipped with a small muffler to control noise levels. Since existing small engine manufactures do not wish to change muffler design, a typical design for such a unit is to include a small metal substrate catalyst for controlling harmful emissions in the existing muffler. In that case, the muffler and catalyst are not independent of each other.

U.S. Pat. No. 6,040,266 discloses an acoustic baffle/catalyst foam support material and a method of producing an acoustic baffle/catalyst foam support material. According to the patent polyurethane open cell foam material is provided having a density between 10-100 ppi. The polyurethane foam is infiltrated with a resin material to produce an impregnated foam. The impregnated foam is pyrolized to form a carbon skeleton forming a carbon foam. The carbon foam skeleton is coated with one or more of the following group of materials to a relative density of five to thirty five (5-35) percent, the group of materials being SiC, $Si_3N_4$, $Mo_2Si_2$ or high temperature metal. A platinum group metal catalyst is then coated onto the metal coated foam.

It is an object of the-present invention to provide a muffler devise for the simultaneous reduction of noise levels and pollutants, such as hydrocarbons, carbon monoxide and nitrogen oxides, from an exhaust gas stream.

SUMMARY OF THE INVENTION

In accordance with this invention, the exhaust gas stream from a small engine or utility engine is directed to a dual function muffler comprising a muffler casing, an inner chamber formed in the muffler, and a catalytically coated supported material for the abatement of sound and emission pollutants such as hydrocarbons, carbon monoxide, and nitrogen oxides. More specifically, the inner chamber or subchamber of the muffler contains a catalytically coated support material, e.g., a reticulated metallic foam matrix, which is coated with one or more precious metal catalysts. In the muffler of the present invention, the engine exhaust gas is forced to flow sequentially through the catalytically coated metallic foam support, and through one or more subsequent muffler chambers, causing the exhaust gas stream to frequently change directions, thus, baffling or reducing the noise.

In another aspect, the present invention relates to a metallic foam catalyst support having a metallic layer deposited thereon by thermal arc spraying, thereby improving catalyst adhesion. The metallic thermal arc sprayed layer in such application is an intermetallic layer or anchor layer and holds the precious metal catalyst layer in place even under small engine stress.

In a further aspect of the present invention, the catalytically coated metallic foam, which comprises a torturous flow path for engine exhaust gas, has a great tendency to collect inorganic deposits with higher efficiency compared to other devices that include traditional ceramic and metallic heat exchangers. Thus, the metallic foam can be zone coated, providing an upstream catalyst free trap zone for trapping of inorganic species, which might otherwise poison the catalyst, and a downstream catalyst zone for the abatement of pollutants such as hydrocarbons, carbon monoxide and nitrogen oxides. Straight channel supports often allow inorganic species to bypass a pre catalyst thereby poisoning a precious metal catalyst prematurely in downstream locations.

Other objectives and advantages of the present invention will become apparent from the following description and appended claims.

DETAILED DESCRIPTION OF THE INVENTION

The present invention relates to an apparatus for an internal combustion engine, particularly a small engine of that type and especially a four-cycle engine, which is capable of both reducing exhaust noise and catalytically controlling pollutant emissions simultaneously and in a single unit. More specifically, this invention relates to a muffler system, which employs a catalytically coated substrate to reduce harmful emissions associated with the exhaust gas stream from a small engine, wherein the catalytic substrate is contained within a void space or inner chamber contained within the muffler.

The muffler of the present invention preferably employs two or more juxtaposed baffle plates in a muffler casing or canister to interrupt the parallel flow of the entering exhaust gas stream, thereby forcing a reduced velocity and deadening the decibel level. The baffle plates contain a void space or chamber therein, which contains a catalytically coated substrate. The cross-sectional configuration can however, be of any convenient shape. The baffle plates preferably are fabricated from a metal, but also can be fabricated from a non-metal, such as a ceramic, by conventional manufacturing techniques.

Figure 1:
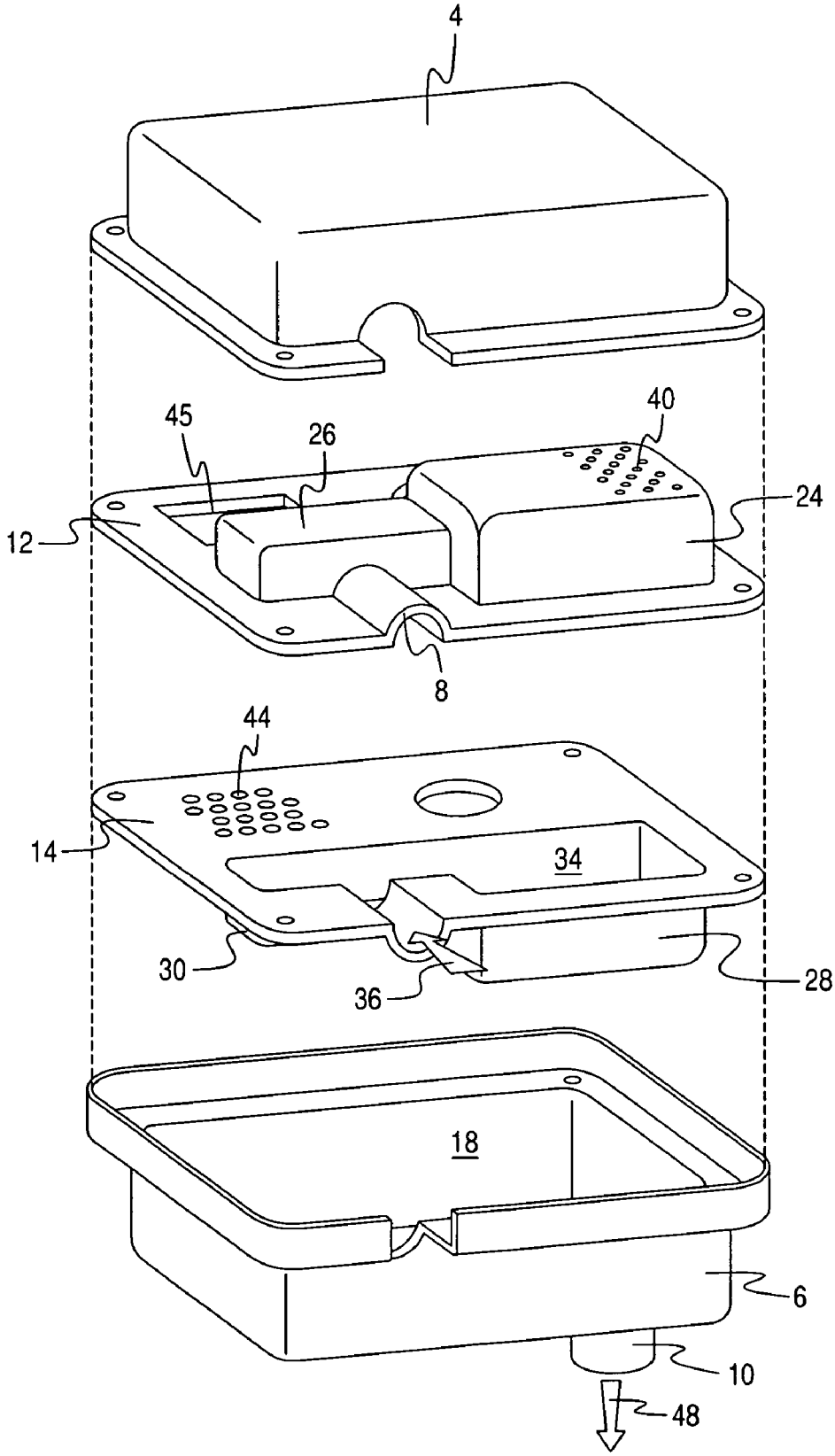
FIG. 1 is a schematic of an exploded view of a muffler constructed in accordance with the present invention.
Figure 2A:
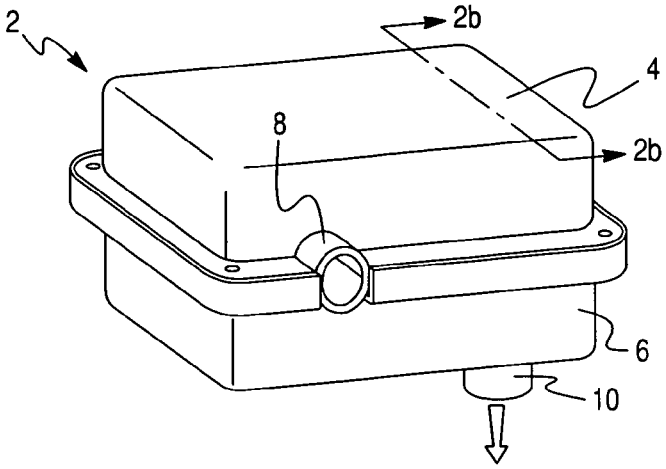
FIG. 2*a* is a schematic of perspective view of a muffler in accordance with the present invention.
Figure 2B:
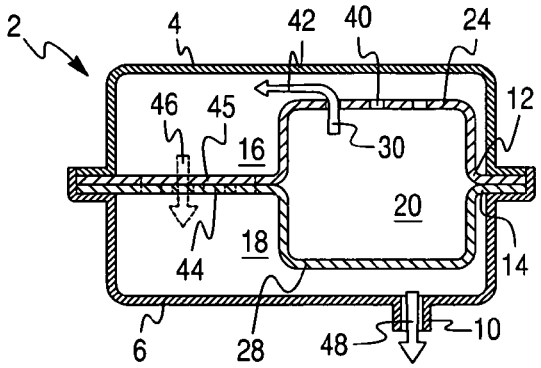
FIG. 2*b* is a cross-sectional view of a muffler in accordance with the present invention taken along line I-I of FIG. 2*a*.
Figure 3:
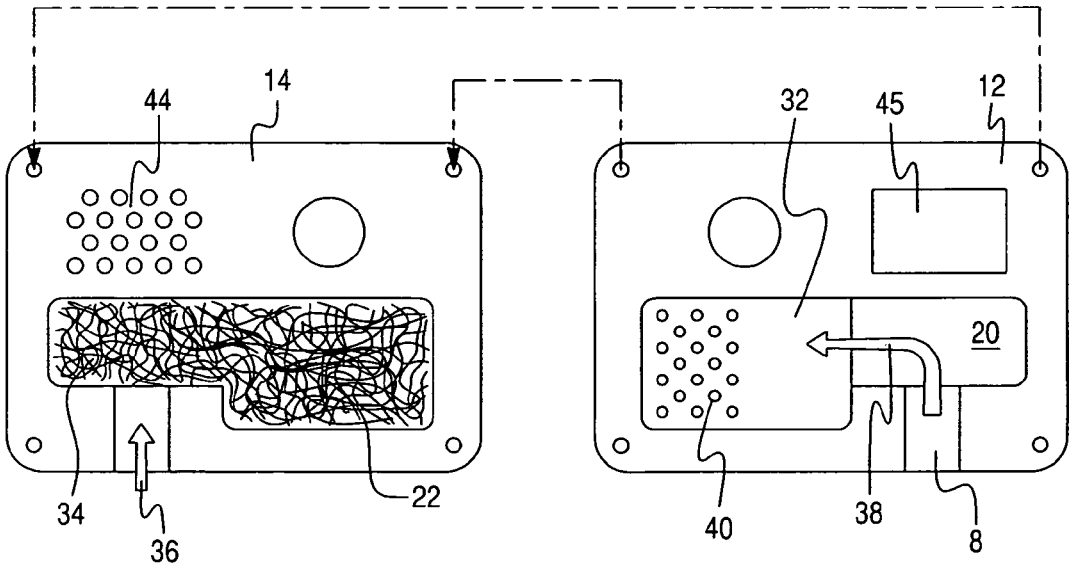
FIG. 3 is a schematic showing the inner baffle plates of a muffler construct of FIG. 1.

An exemplified muffler design of the present invention is seen in FIGS. 1-3. Referring to FIGS. 1-3 a useful muffler 2 includes an upper outer shell 4, a lower outer shell 6, an exhaust inlet 8 therein, and an exhaust outlet 10. The muffler 2 further comprises an upper inner baffle plate 12, and a lower inner baffle plate 14. Upper and lower inner baffle plates 12, 14, respectfully, are aligned parallel and juxtaposed to each other and face each other as mirror images when assembled in the muffler 2. The juxtaposed baffles 12 and 14 lie in the center of the muffler 2 dividing muffler 2 into two main chambers, an upper chamber 16 and a lower chamber 18 (see FIG. 2*b*).

Assembly of the components, in the orientation of FIGS. 1 and 2*b*, have a vertically axially aligned assembly forming in sequence an upper outer shell 4, an upper chamber 16, an upper inner baffle plate 12, an inner chamber 20, a lower inner baffle plate 14, a lower chamber 18, and a lower outer shell 6, which contains an exhaust outlet 10. As shown in FIG. 2*b*, upper chamber 16 is formed between upper outer shell 4 and upper inner baffle plate 12. Inner chamber 20 is formed between upper inner baffle plate 12 and lower inner baffle 14, described in more detail hereinbelow. Lower chamber 18 is formed between lower inner baffle plate 14 and lower outer shell 6.

As shown in FIGS. 1 and 2*b*, upper inner baffle plate 12 has a large drawn out portion 24 and a smaller drawn out portion 26. Similarly, lower inner baffle plate 14 has a large drawn out portion 28 and a smaller drawn out portion 30. The large drawn out portions 24, 28, and the smaller drawn down portions 26, 30 of each baffle plate 12, 14 are juxtaposed. When the muffler 2 is assembled, as in FIG. 2*a*, large and small drawn out potions 24, 26, respectfully, of upper baffle plate 12 form a first inner subchamber 32. Similarly, in the lower inner baffle plate 14 a second inner subchamber 34 in formed therein by large and small drawn out portions 28, 30, respectfully. Subchamber 32 of upper inner baffle plate 12 extends axially upwardly toward upper outer shell 4, and subchamber 34 of lower inner baffle plate 14 extends axially downward toward lower outer shell 6. As shown in FIGS. 1 and 2*b*, these subchambers 32 and 34 are juxtaposed to one another forming inner chamber 20, upon assembly of muffler 2. Preferably, chamber 20 is filled with a catalytically coated substrate 22, for example catalytically coated metallic foam.

As shown in FIGS. 1-3, exhaust gas stream, represented here as arrow 36, from an engine (not shown) enters the muffler 2 through exhaust inlet 8. The exhaust stream 36 flows through exhaust inlet 8 and enters inner chamber 20, and travels through catalytically coated substrate 22, e.g., catalytically coated metallic foam, represented here as arrow 38. The exhaust stream 36 then exits inner chamber 20, and catalytically coated substrate 22, through a first set of apertures 40 located in the large drawn out portion 24 of inner baffle plate 12 and enters upper chamber 16, represented here as arrow 42 (see FIG. 2*b*). The exhaust stream 36 then travels through upper chamber 16 to the left rear portion of upper chamber 16 and exits through a second set of apertures 44, located in the lower baffle plate 14, and an accommodating cut-out portion 45 located in upper baffle plate 12; represented here as arrow 46 (see FIG. 2*b*). The exhaust stream 36 then travels through the lower chamber 18 and exits the muffler through exhaust outlet 10, represented here as arrow 38 (see FIGS. 1 and 2*b*).

The present invention provides a catalytic coated substrate or catalytic substrate. Substrates useful for forming the catalytically coated substrate of the present invention include those metallic substrates which are able to accommodate a high flow rate (preferably >20,000 L/h for a 50 cc engine), are lightweight, and have a low thermal mass. For instance, the substrate can be metallic foam, perforated metal foil, sintered metals, woven wire mesh or non-woven wire mesh. Preferably, the surfaces of the substrates are suitable for application of a metal anchor layer, e.g., a metallic thermal arc sprayed layer, as discussed hereinbelow.

A particularly useful substrate is metallic foam. The metallic foam substrate of the present invention forms an open or reticulated substrate structure comprising metallic cells or pores consisting of struts for the cellular walls (see, for example., FIG. 4). The metallic foam substrate can be further described as a porous matrix having a plurality of irregularly shaped passages wherein exhaust gases undergo multiple random twists and turns in traveling from the upstream side to the downstream side of the foam. This turbulent or tortuous flow path is defined by numerous apertures, pores, channels or similar structural features that cause liquid and/or gas to flow therethrough in turbulent or substantially non-laminar fashion and give the substrate a high surface area per overall volume of the flow path of the fluid through the substrate, e.g., features that create a high mass transfer zone for the fluid therein. In contrast, a dense substrate, such as a plate, tube, foil and the like, has a relatively small surface area per overall volume of the flow path through the substrate regardless of whether it is perforated or not, and do not substantially disrupt laminar flow therethrough. The open or reticulated substrate structure of the metallic foam, importantly not only provides a high mass transfer zone, but such open structure reduces the backpressure.

Figure 4:
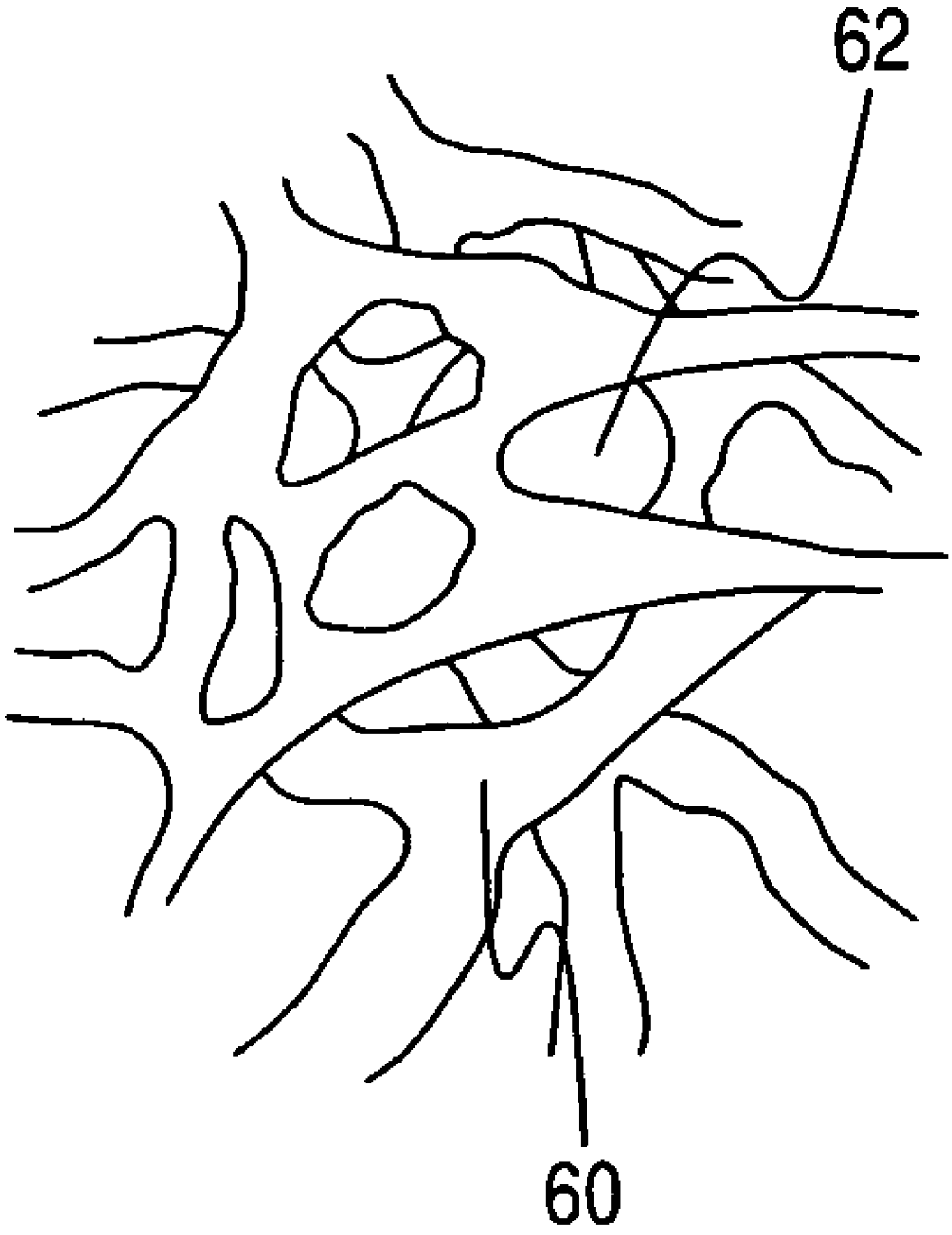
FIG. 4 is an enlarged schematic of metallic foam in accordance with the present invention.

The metallic foam of the present invention may be more readily appreciated by reference to FIG. 4, which depicts an enlarged schematic fragmental view of the three-dimensional network of metallic foam, a non-limiting embodiment of the present invention. Referring to FIG. 4, the figure shows an open network of metallic struts 60 and pores 62 which makes up a torturous pathway for an engine exhaust gas stream. The metallic foam preferentially collects poisonous species primarily in the gaseous phase and serves as a physical barrier to prevent poisonous species from contacting the downstream monolithic precious metal catalyst.

Since these metallic foam structures have higher surface areas than dense substrates and since they permit fluid flow therethrough, they are well-suited for use as a catalyst support. Furthermore, the metallic foam can be used as a trapping member for the trapping of liquid- or gas-borne materials, which might otherwise poison the precious metal catalysts. For example, the metallic foam can be coated in separate zones such that the upstream portion of the metallic foam, may be coated with a thermal arc sprayed layer (as discussed hereinbelow) for use as a trap and the downstream portion, which is coated with a catalyst, can be used for the abatement of pollutants such as hydrocarbons, carbon monoxide and nitrogen oxides in the exhaust stream. The high surface area of the thermal arc sprayed layer provides for improved mass transfer of active species thereby improving the efficiency of the metallic foam trapping zone.

Methods for making foamed metal are known in the art, see e.g., U.S. Pat. No. 3,111,396, which is incorporated herein by reference, and the use of foamed metal as a carrier for a catalytic material has been suggested in the art, see e.g., SAE Technical Paper 971032, entitled "A New Catalyst Support Structure For Automotive Catalytic Converters" by Arun D. Jatkar, which was presented at the International Congress and Exposition, Detroit, Mich., Feb. 24-27, 1997, and Pestryakov et al., Journal of Advanced Materials, 1 (5), 471-476 (1994). Metallic foams can be characterized in various ways, some of which relate to the properties of the initial organic matrix about which the metal is disposed. Some characteristics of foamed metal substrates recognized in the art include cell size, density, free volume, and specific surface area. For example, the surface area may be 1500 times that of a solid substrate having the same dimensions as the foamed substrate. As mentioned by Pestryakov et al, foamed metal substrates useful as carriers for catalyst members may have mean cell diameters in the range of 0.5 to 5 mm, and they may have a free volume of from about 80 to 98%, e.g., 3 to 15 percent of the volume occupied by the foamed substrate may constitute metal. The porosity of the substrate may range from 3 to 80 pores per inch (ppi), e.g., from 3 to 30 ppi, or from 3 to 10 ppi, or from 3 to 5 ppi. In an illustrative range of 10 to 80 ppi, other characteristics such as cells per square inch may range from 100 to 6400 and the approximate web diameter may vary from 0.01 inch to 0.004 inch. Such foams may have open-cell reticulated structures, based on a reticulated/interconnected web precursor. They typically have surface areas that increase with porosity in the range of from about 700 square meters per cubic foot of foam ($m^2/ft^3$) at about 10 ppi to 4000 $m^2/ft^3$ at about 60 ppi, etc. Other suitable metallic foamed substrates have surface areas ranging from about 200 square feet per cubic foot of foamed metal ($ft^2/ft^3$) at about 10 ppi to about 1900 $ft^2/ft^3$ at about 80 ppi. One such substrate has a specific weight of 500 g/m at a thickness of about 1.6+/−0.2 millimeters with a porosity of 110 ppi. They may have volume densities in the range of 0.1 to 0.3 grams per cubic centimeter (g/cc).

Metallic foamed substrates can be formed from a variety of metals, including iron, titanium, tantalum, tungsten noble metals, common sinterable metals such as copper, nickel, bronze, etc., aluminum, zirconium, etc., and combinations and alloys thereof such as steel, stainless steel, Hastalloy, Ni/Cr, Inconel (nickel/chromium/iron), Monel (nickel/copper), and Fecralloy (iron/chromium/aluminum/yttrium). In one embodiment, the metallic foam substrate is selected from the group consisting of stainless steel, titanium, Fecralloy, aluminum zirconate, aluminum titanate, aluminum phosphate, cordierite, mullite and corundum. In another embodiment, Fecralloy (FeCrAlY) is exemplified. A suitable metallic foam substrate for use with the present invention has a volume occupied by the foamed substrate of about 3 percent to about 12 percent. From about 6 to about 8 percent is also exemplified.

In a preferred embodiment of the invention, the metallic foam substrate of the present invention is pretreated prior to deposition of the catalyst composition to improve the adherence of composition on the substrate. Pretreatment of the substrate can be conducted by applying a metal anchor layer to the substrate by known thermal spraying techniques before the catalyst slurry is applied. Such a layer can be referred to as a metallic thermal arc sprayed layer. These techniques include plasma spraying, single wire spraying, high velocity oxy-fuel spraying, combustion wire and/or powder spraying, electric arc spraying etc. Preferably the metal anchor layer is applied by electric arc spraying.

Electric arc spraying, e.g., twin wire arc spraying, of a metal (which term, as used herein, includes mixtures of metals, including without limitation, metal alloys, pseudoalloys, and other intermetallic combinations) onto a metal foraminous substrate yields a structure having superior utility as a substrate for catalytic materials in the field of catalyst members. Twin wire arc spraying (encompassed herein by the term "wire arc spraying" and by the broader term "electric arc spraying") is a known process, as indicated by the above reference to U.S. Pat. No. 4,027,367 which is incorporated herein by reference. Briefly described, in the twin wire arc spray process, two feedstock wires act as two consumable electrodes. These wires are insulated from each other as they are fed to the spray nozzle of a spray gun in a fashion similar to wire flame guns. The wires meet in the center of a gas stream generated in the nozzle. An electric arc is initiated between the wires, and the current flowing through the wires causes their tips to melt. A compressed atomizing gas, usually air, is directed through the nozzle and across the arc zone, shearing off the molten droplets to form a spray that is propelled onto the substrate. Only metal wire feedstock can be used in an arc spray system because the feedstock must be conductive. The high particle temperatures created by the spray gun produce minute weld zones at the impact point on a metallic substrate. As a result, such electric arc spray coatings (sometimes referred to herein as "anchor layers") maintain a strong adhesive bond with the substrate.

Operating parameters for wire arc spraying for forming anchor layer on foraminous substrates are disclosed in U.S. patent application Ser. No. 09/301,626, filed Apr. 29, 1999 (the '626 application), now U.S. Publication No. 2002/0128151, published Sep. 12, 2002, the disclosure of which is hereby incorporated by reference in its entirety.

Anchor layers of a variety of compositions can be deposited on a substrate by utilizing, without limitation, feedstocks of the following metals and metal mixtures: Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels, and, optionally, mixtures of one or more thereof. One specific example of a metal useful for wire arc spraying onto a substrate in accordance with the '626 application is a nickel/aluminum alloy that generally contains at least about 90% nickel and from about 3% to 10% aluminum, preferably from about 4% to 6% aluminum by weight. Such an alloy may contain minor proportions of other metals referred to herein as "impurities" totaling not more than about 2% of the alloy. A preferred specific feedstock alloy comprises about 95% nickel and 5% aluminum and may have a melting point of about 2642° F. Some such impurities may be included in the alloy for various purposes, e.g., as processing aids to facilitate the wire arc spraying process or the formation of the anchor layer, or to provide the anchor layer with favorable properties.

Electric arc spraying a metal onto a metal substrate yields a superior substrate for catalytic materials relative to substrates having metal anchor layers applied thereto by other methods. Catalytic materials have been seen to adhere better to a substrate comprising an electric arc sprayed anchor layers than to a substrate without an intermediate layer applied thereto and even better than to a substrate having a metal layer deposited thereon by plasma spraying. Catalytic materials disposed on metal substrates, without intermediate layers between the substrate and the catalytic material, often did not adhere sufficiently well to the substrate to provide a commercially acceptable product. Metal substrates having an intermediate layer applied by other thermal spraying techniques typically suffer the same drawbacks. For example, a metal substrate having a metal intermediate layer that was plasma-sprayed thereon and having a catalytic material applied to the intermediate layer failed to retain the catalytic material, which flaked off upon routine handling, apparently due to a failure of the intermediate layer to bond with the substrate. The catalytic material on other substrates was seen to spall off upon normal use, apparently as a result of being subjected to a high gas flow rate, to thermal cycling, to the eroding contact of high temperature steam and other components of the exhaust gas stream, vibrations, etc. Application of the intermediate layer by electric arc spraying therefore improves the durability of catalyst members comprising catalytic materials carried on foraminous substrates by improving their durability.

A suitable catalytic material for use on metallic foam substrate can be prepared by dispersing a compound and/or complex of any catalytically active component, e.g., one or more platinum group metal compounds or complexes, onto relatively inert bulk support material. As used herein, the term "compound", as in "platinum group metal compound" means any salt, complex, or the like of a catalytically active component (or "catalytic component") which, upon calcination or upon use of the catalyst, decomposes or otherwise converts to a catalytically active form, which is often, but not necessarily, an oxide. The compounds or complexes of one or more catalytic compounds may be dissolved or suspended in any liquid which will wet or impregnate the support material, which does not adversely react with other components of the catalytic material and which is capable of being removed from the catalyst by volatilization or decomposition upon heating and/or the application of a vacuum. Generally, both from the point of view of economics and environmental aspects, aqueous solutions of soluble compounds or complexes are preferred. For example, suitable water-soluble platinum group metal compounds are chloroplatinic acid, amine solubilized platinum hydroxide, rhodium chloride, rhodium nitrate, hexamine rhodium chloride, palladium nitrate or palladium chloride, etc. The compound-containing liquid is impregnated into the pores of the bulk support particles of the catalyst, and the impregnated material is dried and preferably calcined to remove the liquid and bind the platinum group metal into the support material. In some cases, the completion of removal of the liquid (which may be present as, e.g., water of crystallization) may not occur until the catalyst is placed into use and subjected to the high temperature exhaust gas. During the calcination step, or at least during the initial phase of use of the catalyst, such compounds are converted into a catalytically active form of the platinum group metal or a compound thereof. An analogous approach can be taken to incorporate the other components into the catalytic material. Optionally, the inert support materials may be omitted and the catalytic material may consist essentially of the catalytic component deposited directly on the sprayed foraminous substrate by conventional methods.

Preferred platinum group metal components for use in the articles of the invention include platinum, palladium, rhodium, ruthenium and iridium components. Platinum, palladium and rhodium components are particularly preferred. When deposited on a foraminous substrate (e.g., metal screen) such components are generally deposited at a concentration of from 0.001 to 0.01 g/in2 for typical utility engine applications.

Suitable support materials for the catalytic component include alumina, silica, titania, silica-alumina, alumino-silicates, aluminum-zirconium oxide, aluminum-chromium oxide, etc. Such materials are preferably used in their high surface area forms. For example, gamma-alumina is preferred over alpha-alumina. It is known to stabilize high surface area support materials by impregnating the material with a stabilizer species. For example, gamma-alumina can be stabilized against thermal degradation by impregnating the material with a solution of a cerium compound and then calcining the impregnated material to remove the solvent and convert the cerium compound to a cerium oxide. The stabilizing species may be present in an amount of from about, e.g., 5 percent by weight of the support material. The catalytic materials are typically used in particulate form with particles in the micron-sized range, e.g., 10 to 20 microns in diameter, so that they can be formed into a slurry and coated onto a substrate.

A typical catalytic material for use on a catalyst member for a small engine comprises platinum, palladium and rhodium dispersed on an alumina and further comprises oxides of neodymium, strontium, lanthanum, barium and zirconium. Some suitable catalysts are described in U.S. patent application Ser. No. 08/761,544 filed Dec. 6, 1996, the disclosure of which is incorporated herein by reference. In one embodiment described therein, a catalytic material comprises a first refractory component and at least one first platinum group component, preferably a first palladium component and optionally, at least one first platinum group metal component other than palladium, an oxygen storage component which is preferably in intimate contact with the platinum group metal component in the first layer. An oxygen storage component ("OSC") effectively absorbs excess oxygen during periods of lean engine operation and releases oxygen during periods of fuel-rich engine operation and thus ameliorates the variations in the oxygen/hydrocarbon stoichiometry of the exhaust gas stream due to changes in engine operation between a fuel-rich operation mode and a lean (i.e., excess oxygen) operation mode. Bulk ceria is known for use as a OSC, but other rare earth oxides may be used as well. In addition, as indicated above, a co-formed rare earth oxide-zirconia may be employed as a OSC. The co-formed rare earth oxide-zirconia may be made by any suitable technique such as co-precipitation, co-gelling or the like. One suitable technique for making a co-formed ceria-zirconia material is illustrated in the article by Luccini, E., Mariani, S., and Sbaizero, O. (1989) "Preparation of Zirconia Cerium Carbonate in Water With Urea" Int. J. of Materials and Product Technology, vol. 4, no. 2, pp. 167-175, the disclosure of which is incorporated herein by reference. As disclosed starting at page 169 of the article, a dilute (0.1 M) distilled water solution of zirconyl chloride and cerium nitrate in proportions to promote a final product of ZrO2-10 mol % CeO2 is prepared with ammonium nitrate as a buffer, to control pH. The solution was boiled with constant stirring for two hours and complete precipitation was attained with the pH not exceeding 6.5 at any stage.

Any suitable technique for preparing the co-formed rare earth oxide-zirconia may be employed, provided that the resultant product contains the rare earth oxide dispersed substantially throughout the entire zirconia matrix in the finished product, and not merely on the surface of the zirconia particles or only within a surface layer, thereby leaving a substantial core of the zirconia matrix without rare earth oxide dispersed therein. Thus, co-precipitated zirconium and cerium (or one other rare earth metal) salts may include chlorides, sulfates, nitrates, acetates, etc. The co-precipitates may, after washing, be spray dried or freeze dried to remove water and then calcined in air at about 500° C. to form the co-formed rare earth oxide-zirconia support. The catalytic materials of aforesaid application Ser. No. 08/761,544 may also include a first zirconium component, at least one first alkaline earth metal component, and at least one first rare earth metal component selected from the group consisting of lanthanum metal components and neodymium metal components. The catalytic material may also contain at least one alkaline earth metal component and at least one rare earth component and, optionally, at least one additional platinum group metal component preferably selected from the group consisting of platinum, rhodium, ruthenium, and iridium components with preferred additional first layer platinum group metal components being selected from the group consisting of platinum and rhodium and mixtures thereof.

Another preferred catalytic material contains a platinum group metal component comprising platinum and rhodium dispersed on a refractory oxide support component comprising alumina, co-formed ceria-zirconia, baria and zirconia. The preparation of this catalytic material is exemplified in Example 1 (below).

A variety of deposition methods are known in the art for depositing catalytic material on a foraminous substrate. These methods of applying the catalytic component onto the substrate constitute a separate step in the manufacturing process relative to the application of any anchor layer (if applied) to the substrate.

Methods for depositing catalytic material on the foraminous substrate include, for example, disposing the catalytic material in a liquid vehicle to form a slurry and wetting the foraminous substrate with the slurry by dipping the substrate into the slurry, spraying the slurry onto the substrate, etc. Alternatively, the catalytic material may be dissolved in a solvent and the solvent may then be wetted onto the surface of the foraminous substrate and thereafter removed to leave the catalytic material, or a precursor thereof, on the foraminous substrate. The removal procedure may entail heating the wetted substrate and/or subjecting the wetted substrate to a vacuum to remove the solvent via evaporation.

Another method for depositing a catalytic material onto the foraminous substrate is to provide the catalytic material in powder form and adhere it to the substrate via electrostatic deposition. This method would be appropriate for producing a catalyst member for use in liquid phase chemical reactions.

The following examples further illustrate the present invention, but of course, should not be construed as in any way limiting its scope.

EXAMPLE 1

Preparation of Catalyst Composition Containing Platinum and Rhodium in a 5:1 Ratio A preferred catalyst composition useful for certain catalyst articles of the invention contains platinum and rhodium components in about at 5:1 ratio (by weight). The composition is prepared as described below.

First, platinum and rhodium compounds are dispersed on to a high surface area (150 m2/g), gamma alumina support. An aqueous slurry of the alumina (97% solids, 3079 g) is impregnated with an aqueous solution containing 74 g of amine-solubilized platinum hydroxide. Thereafter, the slurry is impregnated with an aqueous solution containing 14.7 g of rhodium nitrate. The slurry is combined with a mixture of octanol (0.3% by weight based on the total solids), 90% acetic acid and water. The resulting slurry (47% by weight solids) is mixed and ball-milled so that the 90% of the particles have a particle size of 12 microns or less.

An aqueous slurry containing ceria-zirconia composite material (containing about a 50:50 weight ratio of ceria to zirconia, 2329 g), zirconium acetate (238 g), barium acetate (299 g) and acetic acid is added to the above-milled slurry. The resulting slurry (47% by weight solids) is mixed and milled so that the 90% of the particles have a particle size of 7 microns or less. An aqueous mixture of pseudoboehmite (60 g) is added to the resulting milled slurry to give a coating slurry containing 45% by weight of solids.

What is claimed is:

1. An apparatus for the reduction of utility engine sound and emissions comprising, a muffler casing, juxtaposed baffle plates disposed within the muffler casing forming an inner chamber, a reticulated metallic foam matrix contained in said inner chamber, and one or more precious metal catalysts coupled to said reticulated metallic foam matrix.

2. The apparatus of claim 1, wherein said reticulated metallic foam matrix is selected from the group consisting of stainless steel, titanium, FeCrAlloy, aluminum zirconate, aluminum titanate, aluminum phosphate, cordierite, mullite and corundum.

3. The apparatus of claim 2, wherein said reticulated metallic foam matrix is a FeCrAlloy foam.

4. The apparatus of claim 1, wherein said reticulated metallic foam matrix is coated with a metallic thermal arc sprayed layer and wherein said catalyst is applied on said metallic thermal arc sprayed layer.

5. The apparatus of claim 4, wherein said metallic thermal arc sprayed layer is selected from the group consisting of Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels.

6. The apparatus of claim 4, wherein said metallic thermal arc sprayed layer is coated with a refractory oxide layer selected from the group consisting of refractory oxides such as alumina, gamma-alumina, titania, zirconia, zirconia-alumina, zirconia-titania, titania-alumina, lanthana-alumina, baria-zirconia-alumina, niobia-alumina, and silica-leached cordierite.

7. The apparatus of claim 1, wherein said reticulated metallic foam matrix is zone coated with said catalyst thereby providing for an upstream catalyst free trap zone and a separate downstream catalyst zone.

8. The apparatus of claim 1, wherein the baffle plates form an upper chamber and a lower chamber in fluid communication with the inner chamber.

9. An apparatus for the reduction of utility engine sound and emissions comprising, a muffler casing, juxtaposed baffle plates contained within the muffler and forming an inner chamber within said muffler, a reticulated FeCrAlloy foam matrix contained in said inner chamber, and one or more precious metal catalysts coupled to said reticulated metallic foam matrix.

10. The apparatus of claim 9, wherein said reticulated metallic foam matrix is coated with a metallic thermal arc sprayed layer and wherein said catalyst is applied on said metallic thermal arc sprayed layer.

11. The apparatus of claim 10, wherein said metallic thermal arc sprayed layer is selected from the group consisting of Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels.

12. The apparatus of claim 10, wherein said metallic thermal arc sprayed layer is coated with a refractory oxide layer selected from the group consisting of refractory oxides such as alumina, gamma-alumina, titania, zirconia, zirconia-alumina, zirconia-titania, titania-alumina, lanthana-alumina, baria-zirconia-alumina, niobia-alumina, and silica-leached cordierite.

13. The apparatus of claim 9, wherein said reticulated metallic foam matrix is zone coated with said catalyst thereby providing for an upstream catalyst free trap zone and a separate downstream catalyst zone.

14. A method for reducing noise levels and for the abatement of utility engine emissions, said method comprising:

(a) directing an engine exhaust gas stream through a muffler, said muffler comprising:

(i) at least two baffle plates;

(ii) a reticulated metallic foam matrix coated with one or more precious metal catalysts for the abatement of utility engine emissions, wherein said metallic foam is contained within said baffle plates; and (iii) one or more chambers located adjacent to said baffle plates;

(b) directing said engine exhaust gas stream through said foam matrix and subsequently through said one or more chambers thereby reducing engine emissions and reducing noise; and (c) directing said engine exhaust gas stream from said one or more chambers out of said muffler.

15. The method of claim 14, wherein said metallic foam is selected from the group consisting of stainless steel, titanium, FeCrAlloy, aluminum zirconate, aluminum titanate, aluminum phosphate, cordierite, mullite and corundum.

16. The method of claim 14, wherein said metallic foam is coated with a metallic thermal arc sprayed layer selected from the group consisting of Ni, Ni/Al, Ni/Cr, Ni/Cr/Al/Y, Co/Cr, Co/Cr/Al/Y, Co/Ni/Cr/Al/Y, Fe/Al, Fe/Cr, Fe/Cr/Al, Fe/Cr/Al/Y, Fe/Ni/Al, Fe/Ni/Cr, 300 and 400 series stainless steels.

17. The method of claim 16, wherein said metallic foam is coated with said metallic thermal arc sprayed layer and a refractory oxide layer selected from the group consisting of refractory oxides such as alumina, gamma-alumina, titania, zirconia, zirconia-alumina, zirconia-titania, titania-alumina, lanthana-alumina, baria-zirconia-alumina, niobia-alumina, and silica-leached cordierite.

18. The method of claim 14, wherein said baffle plates are juxtaposed forming an inner chamber therein, wherein said reticulated metallic foam matrix coated with one or more precious metal catalysts is contained within said inner chamber, and wherein said engine exhaust gas stream is directed through said inner chamber.

19. The method of claim 18, wherein said one or more chambers comprise an upper and lower chamber dispersed on opposite sides of said juxtaposed baffle plates, wherein said engine exhaust gas stream is directed sequentially through said reticulated metallic foam, said upper chamber, and said lower chamber.

* * * * *